US006149085A

United States Patent [19]

Fetzer et al.

[11] Patent Number: 6,149,085

[45] Date of Patent: Nov. 21, 2000

[54] HOUSING FOR A ROLLING MILL

[75] Inventors: Wilhelm Fetzer, Niederuzwil, Switzerland; Urs V. Keller, Plymouth, Minn.

[73] Assignee: Buhler AG, Uzwil, Switzerland

[21] Appl. No.: 09/019,717

[22] Filed: Feb. 6, 1998

[51] Int. Cl.[7] ..... B02C 4/02

[52] U.S. Cl. ..... 241/227; 241/285.1

[58] Field of Search ..... 241/159, 227, 241/285.1, 285.2

[56] References Cited

U.S. PATENT DOCUMENTS

| | | | |
|---|---|---|---|
| 344,258 | 6/1886 | Dunne | 241/285.1 |
| 1,743,911 | 1/1930 | Borton | 241/285.2 |
| 3,899,965 | 8/1975 | Koch et al. | 100/155 |
| 4,101,083 | 7/1978 | Faist | 241/285.1 |
| 4,225,093 | 9/1980 | Rusch et al. | 241/76 |
| 5,813,324 | 9/1998 | Lin | 100/91 |

FOREIGN PATENT DOCUMENTS

| | | |
|---|---|---|
| 1524792 | 9/1978 | United Kingdom . |

*Primary Examiner*—John M. Husar
*Attorney, Agent, or Firm*—Burns, Doane, Swecker & Mathis, LLP

[57] ABSTRACT

The present invention relates to a housing provided for a rolling mill. The housing includes two sidewalls and at least two horizontal beams for receiving a roll unit. This construction is characterized in having at least one further additional beam arranged in a vertical spacing to the beams, whereby the beams pass through the side walls or are fastened partly outside thereof.

17 Claims, 4 Drawing Sheets

HOUSING FOR A ROLLING MILL

BACKGROUND OF THE INVENTION

1. Field of the Invention

The present invention relates to a housing for a mill for milling cereals and other goods, and including a carrying frame to accommodate a roll unit, or plural rolls separately on attachments.

2. State of the Art

Housings for rolling mills are typically casted constructions, welded metal sheets, profile construction or any combination of these constructions, for separately accommodating the bearings of rolls or a roll unit onto sidewalls.

In commonly assigned U.S. Pat. No. 4,225,093 a lateral exchange of roll units is disclosed, i.e. exchange in the direction of the longitudinal axis of the rolls. A free lateral space next to the machine housing sized according to the length of the rolls is provided. A rolling mill with three roll units needs relatively large spaces between the rolls and considerably more surface for carrying out the exchange and for rebuilding the rolling mill. The rolling mill also comprises a complicated and expensive housing construction. This construction includes four horizontal beams carrying the roll units with three further transverse members. There are also provided additional support plates mounted on the upper face on the horizontal beams for the bearings of the roll units.

Commonly assigned DE-PS 2610742, which corresponds to U.K. Patent Specification 1,524,792, is pertinent prior art for the present invention and also discloses a housing for a rolling mill. The housing comprises two vertical frames connected transversely with transverse beams as well as the sidewalls and extending parallel with the rolls. Two beams connecting the frames with each other are shaped as supporting plates and form a bearing for the roll unit. The roll unit is pulled transversely towards the bearings through the frontal frame, and can be pulled out therefrom. Alternatively, the roll unit can be pulled through the recesses in the sidewalls and along the axes of the rolls in the milling room.

The main disadvantage of this arrangement is the two vertical, square frames increase the total costs of the housing. The access to the roll unit, particularly its detachment from the drive and removal from the housing, is more difficult, because the frames (from the front side) extend beyond the sidewalls. Furthermore, the costs of the housing are increased by an arrangement of a back wall being screwed with the frame and two horizontal beams.

SUMMARY OF THE INVENTION

It is an object of the present invention to provide a housing, which allows for an easy mounting and removal of the rolls or roll unit of a mill in such a way that time- and room-saving can be achieved.

According to exemplary embodiments, a housing for a rolling mill comprises two side walls, which are casted or welded metal sheet or profile construction, or any combination of these constructions, with at least two horizontal beams to accommodate the rolls or the roll unit. The housing is characterized in having at least one further beam vertically spaced from the horizontal beams, whereby the beams extend through the side walls or are fastened partly outside thereof. An embodiment with the vertical spacing between the beams makes available that, on the one hand, the rolls or the roll unit can be placed transversely towards the bearing arrangement (for example, a bearing attachment) and, on the other hand, removed respectively therefrom.

For practical reasons, a further additional beam in a vertical spacing to the horizontal beams can also be provided. For example, three horizontal beams can be used.

The frame beams can be made suitably as, for example, hollow profiles and can be screwed or welded with the sidewalls.

The bearings of the rolls can be placed advantageously directly onto the beams or indirectly onto supporting plates connected with the corresponding beams.

The sidewalls can have suitable slots for mounting of the roll unit(s). The sidewalls can, for example, have two slots so that each roll can be mounted from either side.

The beams and the sidewalls can have slots and holes, and can have connecting and fastening means.

The beams can be provided as a direct support for the roll bearing. The beams can also be provided as a support for an attachment of the roll bearings.

The beams can be provided as a support or a fastening for the transmission pulley and for a take-up device for the transmission between the rolls. The beams can also be provided as a support and/or a fastening for the motor base. The beams can also be provided as a support and/or a fastening for any panelling and any belt guards.

Housings can be mounted on top of each other and/or back-to-back or in any other combination forming a multi-stage roller mill. A roll grinding and turning device for servicing the roll surface can be provided on the beams. A roll mounting-and-removing device for servicing the rolls can also be provided on the beams.

A housing with side walls having, for example, one slot can be provided for a cracking mill. A housing with sidewalls having, for example, two slots can be provided for a rolling mill for a flaking mill.

BRIEF DESCRIPTION OF THE DRAWINGS

Further details of the invention will become apparent from the following description of preferred embodiments schematically illustrated in the drawings wherein like elements are represented by like numerals, and wherein.

DETAILED DESCRIPTION OF THE PREFERRED EMBODIMENTS

Figure 1:
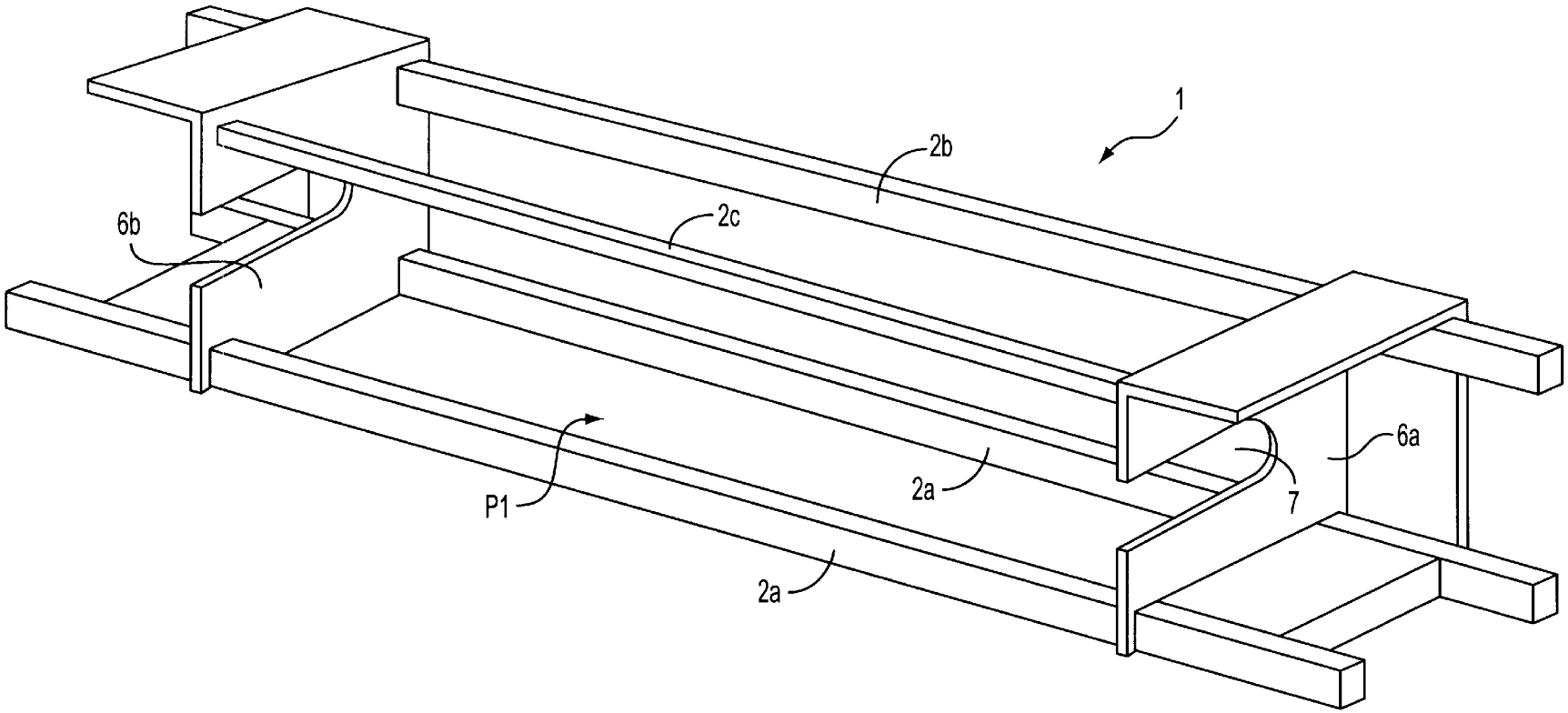
FIG. 1 is a simplified perspective view of an exemplary housing comprising beams and side walls.

FIG. 1 shows an exemplary housing (1) for one-sided roll mounting-and removal, particularly for mills, such as cracking mills, having three beams (two lower beams (2*a*) and an upper beam (2*b*)), an additional beam (2*c*) and two sidewalls (6*a*, 6*b*). The lower beams (2*a*) are connected transversely with each other through the sidewalls (6*a*, 6*b*). The other upper beams (2*b*, 2*c*) are also connected transversely with the side walls (6*a*, 6*b*), vertically spaced from the lower beams (2*a*).

Figure 4:
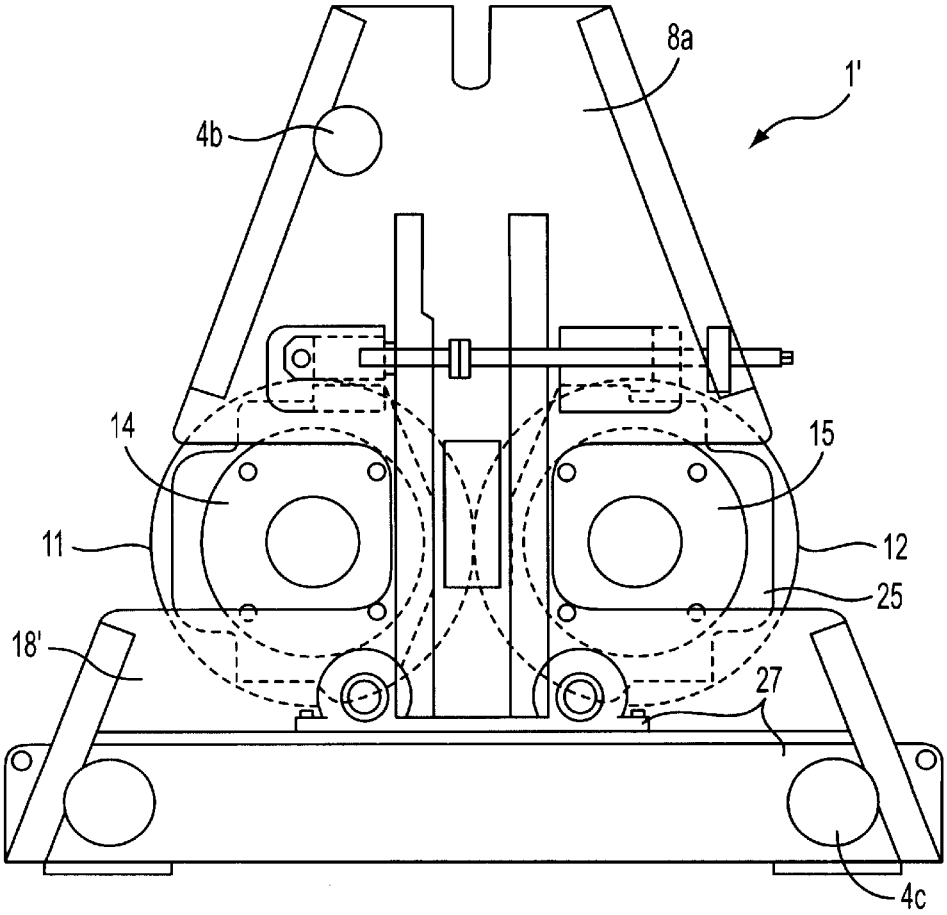
FIG. 4 is a simplified front view of an exemplary housing with two recesses.

The length of the beams (2*a*, 2*b*, 2*c*) can be suitably longer than the length of the roll unit(s) (14, 15), shown in FIG. 4. Each roll unit(s) (14, 15) is placed in the direction of the arrow P1 in FIG. 1 towards the attachment (27), shown in FIG. 4, and fastened on the upper beams (2*a*), respectively removed therefrom. The side walls (6*a*, 6*b*) can be arranged in a such way that multiple housings (1) can be put together as a unitary structure, on top of each other, and/or back-to-back or in any combination. This arrangement can be used, for example, for a multi-stage cracking mill.

Figure 2:
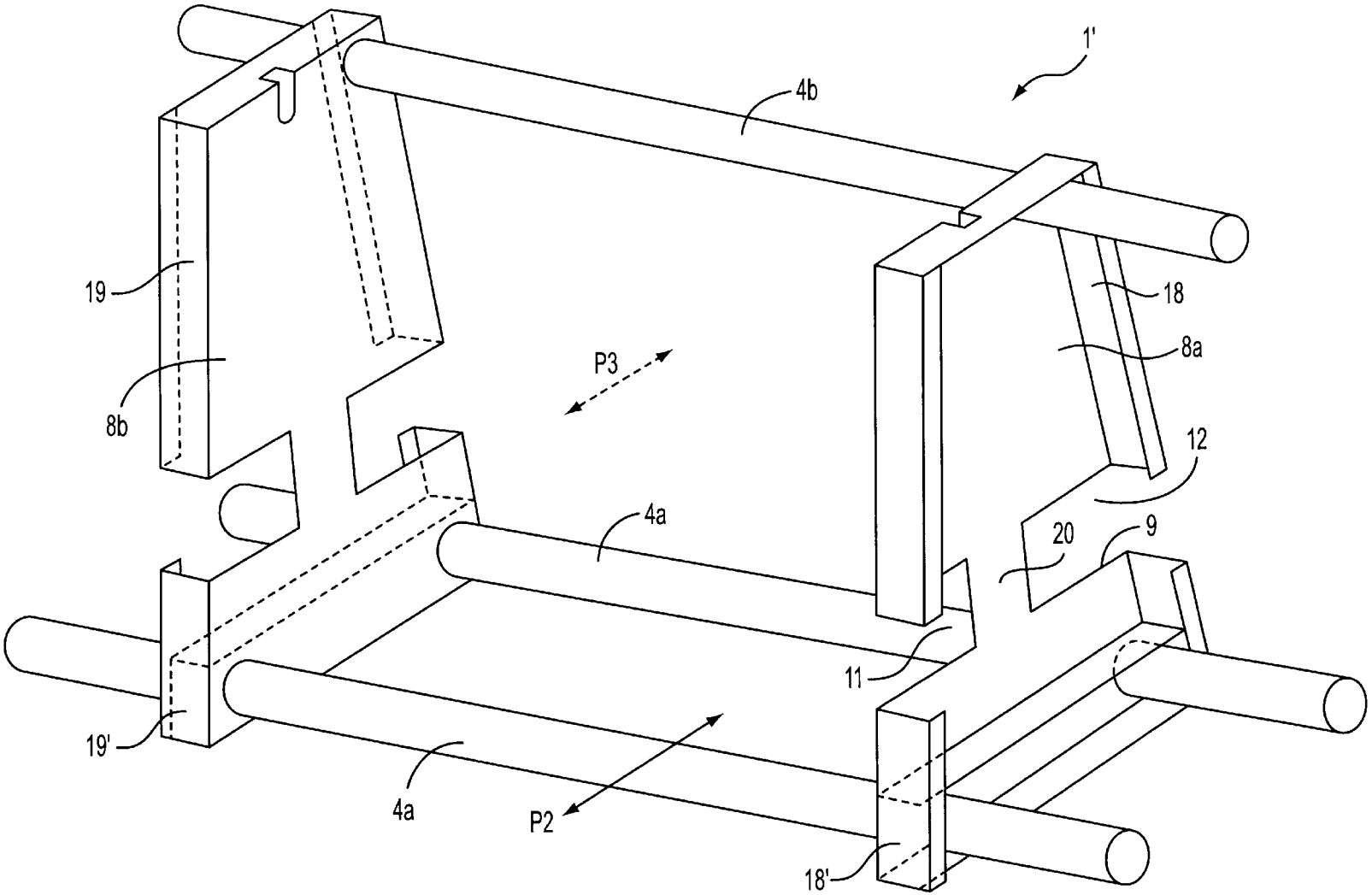
FIG. 2 is a simplified perspective view of another exemplary housing comprising beams and side walls.

FIG. 2 shows another exemplary housing (1') for two-sided roll mounting and removal, which can be used, for example as a flaking mill. The housing comprises two lower horizontal beams (4*a*) and an upper beam (4*b*) vertically spaced from the lower beams, whereby all three beams are connected with the side walls (8*a*, 8*b*). The two lower beams (4*a*) can be connected with each other through the lower parts (18', 19') of the side walls (8*a*, 8*b*), and the upper beam (4*b*) can be connected with the upper parts (18, 19) of the side walls (8*a*, 8*b*) accordingly. The sidewalls (8*a*, 8*b*) have two slots (11, 12) on each side for insertion of the rolls (14, 15), shown in FIG. 4, in the milling room. The slots (11, 12) located in the side walls (8*a*, 8*b*) can be arranged in a vicinity of the connecting piece (20). This connecting piece (20) connects upper parts and the lower parts (18, 18'; 19, 19) of the side walls (8*a*, 8*b*) with each other.

The length of the beams (4*a*, 4*b*) can be longer than the length of the rolls (14, 15). The rolls can be placed separately onto the attachment (27), shown in FIG. 4, 5 and removed therefrom, in the direction of the arrows P2 and P3 in FIG. 2, on each side of the housing. That is, for example, one roll can be inserted in the direction of arrow P2 on one side of the housing while another roll can be removed from the other side in the direction of arrow P3. In this embodiment, the rolls (14, 15) are available for handling during servicing so that only a defective roll can be removed without removing the other roll.

Figure 3:
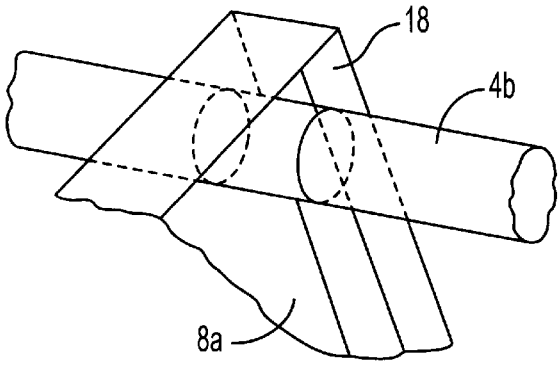
FIG. 3 is an enlarged partial detail of FIG. 2.

FIG. 3 shows in detail an exemplary connection between the upper beam (4*b*) and the upper part (18) of the side wall (8*a*). It is particularly advantageous in this embodiment, that the beam (4*b*) is connected with the side wall (8*a*) in a such way that it passes through the wall or is fastened partly outside thereof. The same connection can also be provided for the lower beams (4*a*) and the lower parts (18', 19') of the sidewalls (8*a*, 8*b*). Therefore, a free access to the roll unit (14, 15) in FIG. 4 can be achieved.

FIG. 4 shows the exemplary housing (1') of FIG. 2 in a frontal view. The rolls (14, 15) can, for example, both be removed from the housing through the recesses (11, 12) in the sidewalls (8*a*, 8*b*) in the same direction of the arrow P3 in FIG. 2. The lower beams (4*a*) can be provided as a direct support for a roll bearing (25). Alternately, the lower beams (4*a*) can accommodate an attachment (27) which in turn supports the roll bearing (25). It is particularly advantageous in this embodiment, that each roll (14, 15), respectively (i.e., a defective roll) can be removed separately from the housing (1').

Figure 5:
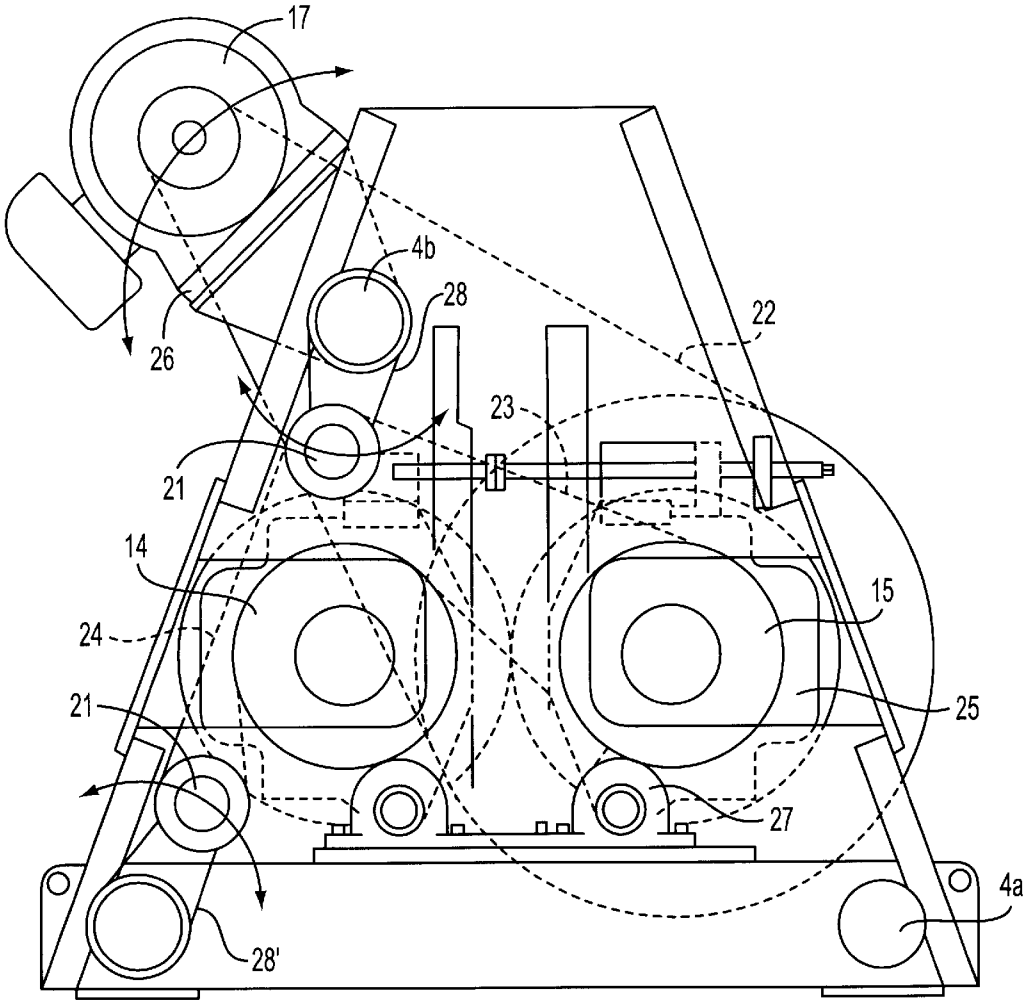
FIG. 5 is a simplified front view of an exemplary housing with two recesses and a drive motor.

FIG. 5 shows a motor (17) arranged on the housing (1') and a motor base (26) arranged on the upper beams (4*b*) accordingly. The motor (17) is fastened pivotally on the motor base (26). This embodiment demands less basic ground space for the rolling mill and no ground space for the drive motors. Furthermore, the motor (17) is not affected by changing the rolls.

The beams (4*a*, 4*b*) can also be provided as an attachment and/or a fastening for a transmission (24) and for a take-up device (28, 28') for transmission (24) between the rolls (14, 15), and for any panelling (e.g., protective panelling) and/or belt guards provided. Transmission rolls 21 can be placed into operative contact with the transmission 24 via the take-up devices (28, 28'). The rolls (21) can be positioned stationarily or pivotally on the beams (4*a*, 4*b*).

The housings 1 and 1', shown in FIG. 1 can be put together on top of each other, back-to-back and/or in any desired combination.

It will be appreciated by those skilled in the art that the present invention can be embodied in other specific forms without departing from the spirit or essential characteristics thereof. The presently disclosed embodiments are therefore considered, in all respects, to be illustrative and non-restricted. The scope of the invention is indicated by the appended claims rather than the foregoing description, and all changes that come within the meaning and range and equivalence thereof are intended to be embraced therein.

What is claimed is:

1. Housing for a rolling mill comprising:

two side walls including at least two horizontal beams for housing one roll unit, two rolls of said roll unit being mounted in different slots of said two side walls; and at least one further beam arranged vertically spaced from the at least two horizontal beams, the at least two horizontal beams being mounted to the two side walls by an arrangement which includes extending the at least two horizontal beams through the two side walls.

2. Housing as claimed in claim 1, wherein said two side walls are formed from at least one of a group consisting of:

casted construction, welded sheet metal construction, profile construction, and any combination of these construction.

3. Housing as claimed in claim 1, wherein the at least two beams and the at least one further beam are made as hollow profiles and screwed or welded with the side walls.

4. Housing as claimed in claim 1, wherein the side walls have two slots for separate accommodation of said two rolls.

5. Housing as claimed in claim 1, wherein the side walls, the at least two beams and the further beam have slots and holes, and connecting and fastening means.

6. Housing as claimed in claim 5, wherein the at least one further beam provides at least one of a support and a fastening for a motor base.

7. Housing as claimed in claim 6, further comprising:

at least one of a grinding device and a rotary device for servicing, said at least one grinding device or rotary device being provided on the at least two beams and the further beam.

8. Housing as claimed in claim 6, wherein a motor base is attached to said at least one further beam.

9. Housing as claimed in claim 8, wherein a motor is fastened pivotally on the motor base.

10. Housing as claimed in claim 1, wherein the at least two beams provide a direct attachment of a roll bearing.

11. Housing as claimed in claim 1, wherein the at least two beams include an attachment for indirectly supporting a roll bearing.

12. Housing as claimed in claim 11, wherein the at least two beams and the at least one further beam provide at least one of a support and a fastening for transmission rolls and for a take-up device for transmission between plural roll units.

13. Housing as claimed in claim 12, wherein the at least two beams and the at least one further beam provide at least one of a support and a fastening for a panelling and belt guards.

14. Housing as claimed in claim 13, further comprising:

a roll mounting-and-removing device for servicing, said roll mounting-and-removing device being provided on the at least two beams and the further beam.

15. Housing as claimed in claim 1, comprising multiple housings mounted in an arrangement selected from a group consisting of:

back to back, one on top of the other, and any combination of these arrangements.

16. Housing as claimed in claim 1, wherein said housing is a rolling mill housing for cracking.

17. Housing as claimed in claim 1, wherein said housing is a rolling mill housing for a flaking.

* * * * *